US007900416B1

(12) United States Patent
Yokubison et al.

(10) Patent No.: US 7,900,416 B1
(45) Date of Patent: Mar. 8, 2011

(54) FLOOR TILE WITH LOAD BEARING LATTICE

(75) Inventors: Ronald Yokubison, Park City, UT (US); Troy D. Mohr, Draper, UT (US); Thayne Haney, Syracuse, UT (US); David F. Smith, Highland, UT (US)

(73) Assignee: Connor Sport Court International, Inc., Salt Lake City, UT (US)

( * ) Notice: Subject to any disclaimer, the term of this patent is extended or adjusted under 35 U.S.C. 154(b) by 653 days.

(21) Appl. No.: 11/729,547

(22) Filed: Mar. 28, 2007

Related U.S. Application Data

(60) Provisional application No. 60/787,010, filed on Mar. 30, 2006.

(51) Int. Cl.
*E04F 15/00* (2006.01)

(52) U.S. Cl. ..... 52/592.1; 52/177; D25/163

(58) Field of Classification Search ..... 52/177, 52/650.3, 180, 588.1, 591.1, 592.1, 220.2, 52/392, 390, 589.1; D25/163, 156–158; D6/585

See application file for complete search history.

(56) References Cited

U.S. PATENT DOCUMENTS

| | | | | |
|---|---|---|---|---|
| 2,082,563 | A | | 6/1937 | Bauer |
| 2,680,698 | A | | 6/1954 | Schnee |
| 3,015,136 | A | | 1/1962 | Doe |
| 3,531,902 | A | | 10/1970 | Costa |
| 3,614,915 | A | | 10/1971 | Perry |
| 3,717,247 | A | | 2/1973 | Moore |
| 3,802,144 | A | | 4/1974 | Spica |
| 3,909,996 | A | | 10/1975 | Ettlinger et al. |
| 3,946,529 | A | | 3/1976 | Chevaux |
| 4,018,025 | A | * | 4/1977 | Collette ..... 52/302.4 |
| 4,054,987 | A | | 10/1977 | Forlenza |
| 4,133,481 | A | | 1/1979 | Bennett |
| 4,167,599 | A | | 9/1979 | Nissinen |
| D255,744 | S | | 7/1980 | Dekko |
| 4,226,060 | A | | 10/1980 | Sato |
| 4,226,064 | A | * | 10/1980 | Kraayenhof ..... 52/180 |
| 4,287,693 | A | | 9/1981 | Collette |
| 4,361,614 | A | | 11/1982 | Moffitt, Jr. |
| 4,436,779 | A | | 3/1984 | Menconi et al. |
| 4,468,910 | A | | 9/1984 | Morrison |

(Continued)

FOREIGN PATENT DOCUMENTS

EP 0044371 1/1982

(Continued)

OTHER PUBLICATIONS

Yokubison, U.S. Appl. No. 11/729,549, filed Mar. 28, 2007.

(Continued)

*Primary Examiner* — Robert J Canfield
*Assistant Examiner* — Brent W Herring
(74) *Attorney, Agent, or Firm* — Thorpe North & Western LLP

(57) ABSTRACT

A floor tile for use in a flooring system comprises an upper surface operable for use as a portion of a flooring installation and a support lattice operable to support the upper surface. The support lattice includes a plurality of support members extending downwardly from an underside of the upper surface and terminating in lower sections collectively defining a subfloor contact profile and a plurality of interconnecting members laterally interconnecting two or more of the support members. At least some of the plurality of support members extend downwardly at an oblique angle to the upper surface.

26 Claims, 4 Drawing Sheets

U.S. PATENT DOCUMENTS 4,478,905 A 10/1984 Neely, Jr. et al.
4,497,858 A 2/1985 Dupont et al.
4,584,221 A 4/1986 Kung
4,590,731 A 5/1986 DeGooyer
4,596,729 A 6/1986 Morrison
D286,575 S 11/1986 Saunders
4,640,075 A 2/1987 Nuncio
4,681,786 A 7/1987 Brown
4,694,627 A 9/1987 Omholt
4,715,743 A 12/1987 Schmanski
4,727,697 A 3/1988 Vaux
4,728,468 A 3/1988 Duke
4,807,412 A 2/1989 Frederiksen
4,849,267 A 7/1989 Ward et al.
4,860,510 A 8/1989 Kotler
4,877,672 A * 10/1989 Shreiner ..... 428/156
4,930,286 A 6/1990 Kotler
4,948,116 A 8/1990 Vaux
5,022,200 A 6/1991 Wilson et al.
5,039,365 A 8/1991 Rutledge et al.
5,048,448 A * 9/1991 Yoder ..... 114/263
5,052,158 A 10/1991 D'Luzansky
5,111,630 A 5/1992 Munsey et al.
D327,748 S 7/1992 Dorfman, Jr.
5,143,757 A 9/1992 Skinner
5,185,193 A * 2/1993 Phenicie et al. ..... 428/57
5,190,799 A * 3/1993 Ellingson, III ..... 428/53
5,205,091 A 4/1993 Brown
5,205,092 A * 4/1993 Taylor ..... 52/177
5,215,802 A 6/1993 Kaars
5,228,253 A 7/1993 Wattelez
5,229,437 A 7/1993 Knight
5,234,738 A 8/1993 Wolf
5,250,340 A 10/1993 Bohnhoff
5,253,464 A 10/1993 Nilsen
5,295,341 A 3/1994 Kajiwara
5,303,669 A 4/1994 Szekely
5,323,575 A 6/1994 Yeh
5,364,204 A 11/1994 MacLeod
5,365,710 A 11/1994 Randjelovic
5,466,489 A 11/1995 Stahl
5,509,244 A 4/1996 Bentzon
5,527,128 A * 6/1996 Rope et al. ..... 404/35
5,542,221 A 8/1996 Streit et al.
5,616,389 A 4/1997 Blatz
5,628,160 A 5/1997 Kung
5,642,592 A 7/1997 Andres
5,647,184 A * 7/1997 Davis ..... 52/592.1
5,682,724 A 11/1997 Randjelovic
5,758,467 A 6/1998 Snear et al.
5,761,867 A 6/1998 Carling
5,787,654 A 8/1998 Drost
5,815,995 A 10/1998 Adam
5,816,010 A 10/1998 Conn
5,950,378 A 9/1999 Council et al.
D415,581 S 10/1999 Bertolini
5,992,106 A 11/1999 Carling et al.
6,032,428 A 3/2000 Rosan et al.
6,044,598 A * 4/2000 Elsasser et al. ..... 52/181
6,047,663 A 4/2000 Moreau et al.
6,068,908 A 5/2000 Kessler et al.
6,098,354 A 8/2000 Skandis
6,101,778 A 8/2000 Martensson
6,101,788 A 8/2000 Weder et al.
6,112,479 A * 9/2000 Andres ..... 52/177
6,171,015 B1 1/2001 Barth et al.
6,228,433 B1 5/2001 Witt
6,230,460 B1 5/2001 Huyett
6,301,842 B1 * 10/2001 Chaney et al. ..... 52/177
6,324,796 B1 12/2001 Heath
6,355,323 B1 3/2002 Iwen et al.
D456,533 S 4/2002 Moller, Jr.
6,418,683 B1 7/2002 Martensson et al.
6,428,870 B1 8/2002 Bohnhoff
6,444,284 B1 9/2002 Kessler et al.
6,451,400 B1 9/2002 Brock et al.
6,467,224 B1 10/2002 Bertolini
6,526,705 B1 * 3/2003 MacDonald ..... 52/177
6,531,203 B2 3/2003 Kessler et al.
6,588,166 B2 7/2003 Martensson et al.
6,605,333 B2 8/2003 Ferreira et al.
6,606,834 B2 8/2003 Martensson et al.
6,617,009 B1 9/2003 Chen et al.
6,637,163 B2 * 10/2003 Thibault et al. ..... 52/177
6,682,254 B1 1/2004 Olofsson et al.
D486,592 S 2/2004 Hong
6,684,582 B2 2/2004 Peart et al.
6,684,592 B2 2/2004 Martin
6,718,715 B2 4/2004 Elliott
D492,426 S 6/2004 Strickler
6,751,912 B2 * 6/2004 Stegner et al. ..... 52/177
6,769,219 B2 8/2004 Schwitte et al.
6,802,159 B1 10/2004 Kotler
6,833,038 B2 12/2004 Iwen et al.
6,878,430 B2 4/2005 Milewski et al.
6,880,307 B2 4/2005 Schwitte et al.
6,895,881 B1 5/2005 Whitaker
7,021,012 B2 4/2006 Zeng et al.
7,029,744 B2 4/2006 Horstman et al.
7,047,697 B1 * 5/2006 Heath ..... 52/177
7,065,935 B2 6/2006 Ralf
7,090,430 B1 8/2006 Fletcher et al.
7,114,298 B2 * 10/2006 Kotler ..... 52/177
7,127,857 B2 10/2006 Randjelovic
D532,530 S * 11/2006 Shuman et al. ..... D25/163
7,211,314 B2 5/2007 Nevison
7,299,592 B2 11/2007 Moller, Jr.
7,340,865 B2 3/2008 Vanderhoef
7,386,963 B2 6/2008 Pervan
7,516,587 B2 * 4/2009 Barlow ..... 52/591.2
7,520,948 B2 4/2009 Tavy et al.
7,531,055 B2 5/2009 Mead
7,571,572 B2 * 8/2009 Moller, Jr. ..... 52/177
7,571,573 B2 * 8/2009 Moller, Jr. ..... 52/177
7,587,865 B2 9/2009 Moller, Jr.
RE41,140 E * 2/2010 Heath ..... 52/177
7,748,176 B2 7/2010 Harding et al.
7,748,177 B2 7/2010 Jenkins et al.
2004/0023006 A1 2/2004 Mead
2004/0035079 A1 2/2004 Evjen
2004/0182030 A1 9/2004 Hinault et al.
2004/0258869 A1 * 12/2004 Walker ..... 428/44
2005/0144867 A1 7/2005 Clarke
2005/0193670 A1 9/2005 Niese et al.
2005/0202208 A1 9/2005 Kelly
2005/0204676 A1 9/2005 Weitzer
2005/0252109 A1 11/2005 Fuccella et al.
2006/0070314 A1 * 4/2006 Jenkins et al. ..... 52/177
2006/0080909 A1 * 4/2006 Harding et al. ..... 52/177
2006/0265975 A1 * 11/2006 Geffe ..... 52/177
2006/0272252 A1 12/2006 Moller
2006/0285920 A1 12/2006 Gettig et al.
2007/0289244 A1 * 12/2007 Haney et al. ..... 52/539
2008/0127593 A1 6/2008 Janesky
2008/0216437 A1 * 9/2008 Prevost et al. ..... 52/589.1
2008/0271410 A1 11/2008 Matthee
2009/0031658 A1 2/2009 Moller, Jr. et al.
2009/0139160 A1 * 6/2009 Hill ..... 52/177

FOREIGN PATENT DOCUMENTS

GB 2262437 6/1993
GB 2 353 543 2/2001
GB 2353543 A * 2/2001

OTHER PUBLICATIONS

Yokubison, U.S. Appl. No. 11/731,017, filed Mar. 28, 2007.
Jenkins, Mark; et al. U.S. Appl. No. 11/244,723, filed Oct. 5, 2008.
Yokubison; U.S. Appl. No. 11/729,547; filed Mar. 28, 2007.
Haney, Thayne et al., U.S. Appl. No. 11/732,714; filed Apr. 3, 2007.
Jenkins, Mark et al., U.S. Appl. No. 29/263,675; filed Jul. 26, 2006.
Cerny; U.S. Appl. No. 12/696,364; filed Jan. 29, 2010.
Haney, Thayne et al., U.S. Appl. No. 12/340,555; filed Dec. 19, 2008.
Synthetic Floor Tile; pp. 1-254.

* cited by examiner

FLOOR TILE WITH LOAD BEARING LATTICE

Priority is claimed to U.S. Provisional Patent Application Ser. No. 60/787,010, filed Mar. 28, 2006, which is hereby incorporated herein by reference in its entirety.

FIELD OF THE INVENTION

Background

The present invention relates generally to modular floor tiles for use in flooring installations. More specifically, the present invention relates to modular floor tiles having load bearing lattices associated therewith.

RELATED ART

It is often desired that a flooring installation be suitable for use in a variety of activities. Such flooring installations are often referred to as "multi-purpose" floors. For example, the floor in a typical primary school cafeteria is used to support tables and chairs to allow children to eat, and should be able to withstand repeated movement of tables, chairs and related equipment onto and off of the flooring surface. This same floor is also often used at other times for performance purposes, such as when students present musical or dramatic programs, and should be capable of sustaining movement of heavy equipment (e.g., pianos, electronic sound equipment, etc.) onto and of off the flooring surface. Also, this same floor is often used at other times for athletic or "active play" purposes as a place where children play basketball, kickball, dodge ball, etc. Accordingly, this same floor should be designed to safely allow these types of active play and sports activities.

While the cafeteria floor in this example would be considered a "multi-purpose" floor, most conventional flooring materials are not well-suited for all of these various types of use. It has been found that flooring materials best suited for long wear, ease of cleaning and maintenance and ease of installation, for example, have often been not well suited for active or sports play. This is due, in part, to the fact that flooring suitable for sports or active play should provide a resilient, cushioned response to reduce the risk of injury in falls and to reduce the stress imposed on bones, muscles and joints of users when running, jumping or otherwise actively playing on the flooring.

However, most so-called multipurpose floors are generally very hard and do not provide an adequate level of resiliency. In a similar fashion, most conventional flooring products that provide good resiliency do not also meet the other requirements of a multipurpose floor: e.g., they may be expensive to install and maintain, and may not withstand the heavy loads periodically applied to multipurpose floors. In particular, conventional flooring products that provide good resiliency perform very poorly under "rolling load" conditions (e.g., conditions in which a heavy load is rolled across the floor, as in the case, for example, where a piano is moved across a floor).

One of the most popular types of conventional "multipurpose" flooring is known as vinyl composition tile, or "VCT." VCT comprises approximately 85% natural limestone, a key ingredient used to make concrete. VCT has proven very popular because it is relatively inexpensive, relatively easy to install and easy to maintain. Despite these attributes, however, VCT has several drawbacks when used as part of a floor that is to be subject to general-purpose use, and is particularly unsuited for active play or sports use.

Perhaps the biggest drawback of VCT is that it is very unforgiving, e.g., it is very much nonresilient. Because of its high limestone content, VCT provides little or no cushioning or shock absorbency, and thus increases the likelihood of injuries occurring during falls, as well as the risk of tendonitis, stress fractures, and joint damage over an extended period of time from playing sports or participating in active play on the VCT floor. This presents a significant problem, especially in school gymnasiums where children are continually participating in active play. Playing daily on a VCT floor can cause both short and long-term injuries to children. For example, without proper protection, a fall from as little as 2 feet, or a direct fall from only 1½ inches, can result in a skull fracture or other traumatic brain injury, as well as broken or fractured bones. Moreover, VCT can be extremely slippery as it does not provide a great amount of surface friction, thus increasing the likelihood of slips and falls.

SUMMARY OF THE INVENTION

The present invention provides a floor tile for use in a flooring system, including an upper surface operable for use as a portion of a flooring installation and a support lattice operable to support the upper surface. The support lattice can include a plurality of support members extending downwardly from an underside of the upper surface and terminating in lower sections collectively defining a subfloor contact profile. A plurality of interconnecting members can laterally interconnect two or more of the support members. At least some of the plurality of support members can extend downwardly at an oblique angle to the upper surface.

In accordance with another aspect of the invention, a floor tile for use in a flooring system is provided, including an upper surface operable for use as a portion of a flooring installation and a support lattice configured to support the upper surface. The support lattice can include a plurality of rails extending longitudinally along an underside of the upper surface and defining a plurality of open spaces therebetween. Each of the plurality of rails can extend downwardly and can terminate in a lower section, with the lower sections collectively defining a subfloor contact profile. At least some of the plurality of rails can be operable to transfer force between the subfloor contact profile and the upper surface in a lateral direction. At least one section of engagement material can be carried by the subfloor contact profile. The engagement material can be formed of a material relatively more pliable than the subfloor contact profile.

In accordance with another aspect of the invention, a floor tile for use in a flooring system is provided, including an upper surface operable for use as a portion of a flooring installation and a support lattice supporting the upper surface. The support lattice can include a plurality of rails extending longitudinally along an underside of the upper surface and defining a plurality of open spaces therebetween. The plurality of rails can extend downwardly from the underside of the upper surface and can terminate in lower sections defining a subfloor contact profile. A plurality of interconnecting members can laterally interconnect two or more of the rails and can at least partially enclose the open spaces defined therebetween. At least some of the plurality of rails or at least some of the interconnecting members can have an arcuate shape.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
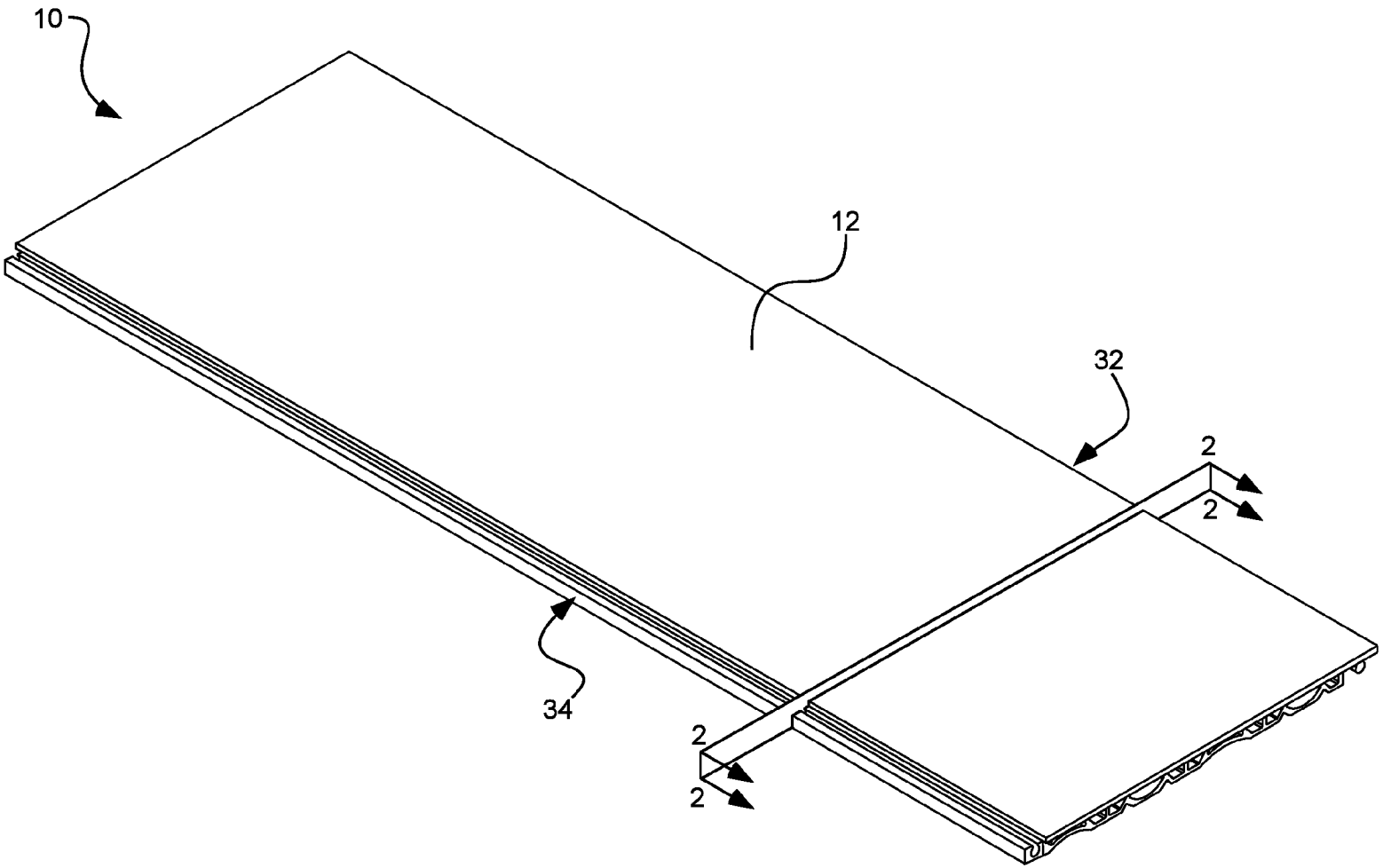
FIG. 1 is a perspective view of a floor tile or plank in accordance with one embodiment of the invention.

Before the present invention is disclosed and described, it is to be understood that this invention is not limited to the particular structures, process steps, or materials disclosed herein, but is extended to equivalents thereof as would be recognized by those of ordinary skill in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "support member" includes one or more of such support members, unless the context clearly dictates otherwise.

DEFINITIONS

In describing and claiming the present invention, the following terminology will be used in accordance with the definitions set forth below.

As used herein, relative terms are used to refer to various components of floor tiles, such as "upper," "lower," "upwardly," "downwardly," etc. It is to be understood that such terms are not used as limitations but rather are used to aid in describing the floor tiles of the present invention in the most straightforward manner. When such terms are used, it is to be understood that they are in reference to the generally accepted orientation of floor tiles when installed or positioned for use. For example, in such an orientation, the floor tile is generally disposed above the subfloor onto which the floor tiles will be installed or placed, with the upper surface of the floor tile exposed upwardly relative to the subfloor.

In addition, the edges of the tiles described herein are at times discussed using the terms "lateral" edges and "end" edges, in order to most clearly identify the novel features of the invention. It is to be understood that the terms "lateral" edges and "end" edges do not limit the scope of the claims herein, and, in particular, it is maintained by Applicants that any structure identifiable as an "edge" of a tile under consideration is considered to read on the claims herein.

As used herein, the term "substantially" refers to the complete or nearly complete extent or degree of an action, characteristic, property, state, structure, item, or result. For example, when an object or group of objects is/are referred to as being "substantially" liquid-tight, it is to be understood that the object or objects are either completely liquid-tight or are nearly completely liquid tight. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, an opening that is "substantially free of" material would either completely lack material, or so nearly completely lack material that the effect would be the same as if it completely lacked material. In other words, an opening that is "substantially free of" material may still actually contain some such material as long as there is no measurable effect as a result thereof.

As used herein, the term "about" is used to provide flexibility to a numerical range endpoint by providing that a given value may be "a little above" or "a little below" the endpoint.

As used herein, the term "subfloor" is to be understood to refer to a variety of flooring structures over or on which the floor tiles of the present invention are to be laid or installed. Examples of subfloors include existing flooring surfaces, such as VCT floors, VAT floors, "Tartan" floors, wooden floors, linoleum floors, ceramic tiles, etc., as well as "unfinished" flooring surfaces such as plywood, particle board, concrete, and the like. It is to be understood that the term subfloor is not to be limited by any commonly used meaning ascribed to the term by any particular field of constructional or architectural endeavor.

As used herein, the term "floor tile" is to be understood to refer to a variety of modular flooring products having a range of sizes. Reference to a "floor tile" can include reference to products commonly referred to as tiles, planks, pads, sections of sheet flooring products, sections of rolled flooring products, etc., as dictated by the particular embodiment in which reference is being made herein to a "floor tile."

As used herein, the terms "resilient" and "resiliency" are to be understood to refer to a characteristic of a floor tile that allows the floor tile to compress or deflect in response to a load applied to the floor tile and then return, or "rebound," to the original state of the floor tile. It is to be understood that, when used, herein, the terms "resilient" or "resiliency" are not to be restricted or broadened due to the sometimes erroneous use of such terms in the flooring industry when referring, for example, to floor tiles such as VCT floor tiles, which are not, in fact, resilient, but tend to either not compress (or deflect) when subjected to a load (e.g., fail to provide shock absorption), or tend to permanently deform after compressing when subjected to such a load (e.g., fail to return to an original state).

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 6 inches" should be interpreted to include not only the explicitly recited values of about 1 inch to about 6 inches, but also include individual values and sub-ranges within the indicated range. This same principle applies to ranges reciting only one numerical value and should apply regardless of the breadth of the range or the characteristics being described.

INVENTION

As illustrated generally in the attached figures, in one aspect of the present invention a modular floor tile 10 for use in a multi-purpose flooring system is provided. The floor tile or plank can include an upper surface 12 operable for use as a portion of a flooring installation. The upper surface is configured to be used in a variety of applications, from everyday use to sports and active play use.

Figure 2A:
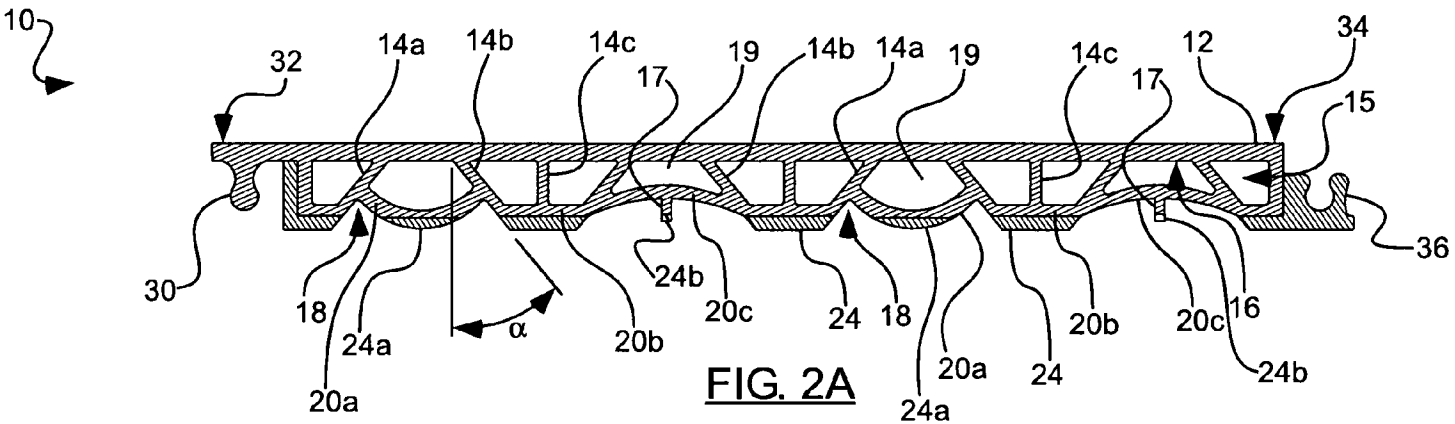
FIG. 2A is an end view of a section of the floor tile of FIG. 1, taken along plane section 2-2 of FIG. 1.

As best appreciated from FIG. 2A, the floor tile 10 can include a support lattice (shown generally at 15) operable to support the upper surface 12 and distribute forces between the upper surface and the subfloor (not shown) beneath. The support lattice can include a plurality of support members or rails (shown individually at 14*a*, 14*b*, 14*c* and referred to herein collectively as "14") that can extend from an underside 16 of the upper surface. The plurality of support members can terminate in lower sections 18 that can collectively define a subfloor contact profile. A plurality of interconnecting members (shown individually at 20*a*, 20*b*, 20*c* and referred to herein collectively as "20") can laterally interconnect two or more of the support members.

As used herein, the term "subfloor profile" is used to indicate the lowermost portions or sections of the floor tile that are configured to contact a subfloor (not shown) on which the present tiles are laid or installed. While the subfloor profile is suitable for resting on a planar subfloor, the subfloor profile is not necessarily planar, but can include a series of lowermost sections aligned in a plane that can rest on the subfloor. For example, in FIG. 2A, the subfloor contact profile is defined by the interconnecting members 20*a* and 20*b*, which carry an engagement material 24 discussed in more detail below. The series of portions aligned in a plane can be interrupted or defined by a series of openings or spaces that do not directly contact the subfloor when the tile is in a relaxed condition. In some embodiments, some portions of the subfloor profile can contact the subfloor only when the tile is subject to significant loading (e.g., compression).

A plurality of at least partial openings 19 can be formed between the interconnecting members 20 and the support members or rails 14. The openings can allow the support members and/or the interconnecting members to move or flex in response to a load applied to the upper surface 12 of the floor tile to provide a high level of resiliency to the floor tile. In some embodiments of the invention, the openings can be fully or partially filled with a pliable filler material that can serve to dampen noise and vibration within the floor tile without significantly interfering with flexing of the support members and/or the interconnecting members.

In the floor tiles shown in the figures, the support members or rails 14 and the interconnecting members 20 extend longitudinally beneath the upper surface 12 of the floor tile along substantially all of the length of the floor tile. That is, the support members and interconnecting members can have a length substantially the same as a length of the floor tile. In other embodiments (not shown), the support members and interconnecting members can have a shorter length and/or can include longitudinal interruptions or openings that longitudinally isolate the support members and/or the interconnecting members into distinct, segmented units.

The support members or rails 14 and the interconnecting members 20 provide the present floor tiles with a substantial degree of resiliency, resulting in a floor tile that can be safely used in active play or sports activities. In one aspect of the invention, calculated performance data indicate that the present floor tiles can provide good fall protection from falls as high as 10 to 12 inches from the floor tile. In contrast, it has been found that VAT (a floor tile often erroneously referred to as "resilient") provides fall protection from only about 1-2 inches, a figure only marginally better than concrete.

The support members 14 can carry load directly between the underside 16 of the upper surface 12 to the subfloor contact profile (e.g., without any intervening structure). In one embodiment of the invention, at least some of the plurality of support members 14 can extend from the underside of the upper surface at an oblique angle to the upper surface, as shown for example, by angle "$\alpha$" in FIG. 2A. In addition, in one embodiment, at least some of the support members or the interconnecting members can include an arcuate shape. By forming the support members or rails and the interconnecting members in an arcuate shape, or extending the support members at an oblique angle from the underside of the upper surface, the support members are capable of distributing loads between the upper surface and the subfloor (not shown) in a diffuse, distributed manner. In other words, the support members and interconnecting members can be operable to distribute load between the subfloor contact profile and the upper surface in both a vertical direction and in a lateral direction.

This feature of the invention advantageously increases the magnitude and type of loads that can be supported and "absorbed" by the present tiles without the tiles incurring permanent deformation. In particular, it has been found that the present floor tiles are capable of withstanding so-called "rolling loads" equally well, if not better than, conventional floor tiles that provide a playing surface with good resiliency.

While some so-called "resilient" floors, such as VAT and VCT, claim to provide a resilient response, they are, in fact, not properly characterized as "resilient" as they do not provide any significant level of shock absorption due to their high rigidity. Thus, while VAT and VCT floors are capable of providing good rolling load resistance, they fail to provide good shock absorption, impact protection and/or shock attenuation. The present floor tiles have been found to provide both a high level of resiliency and good response to rolling loads. The floor tiles of the present invention are thus well suited for multipurpose flooring, as the tiles provide good resiliency for active play or sports play, yet are sufficiently strong and rigid to allow use in an area utilized for eating (e.g., cafeterias) and/or performance purposes, or for general purpose use.

The upper surface 12 of the floor tile shown in the figures generally includes a substantially continuous, uninterrupted plane that can be easily cleaned and maintained, even in areas of potentially heavy soilage, such as in cafeterias. In other embodiments (not shown), however, the upper surface can include a textured surface or a surface interrupted by indentations or openings, as a particular application may dictate.

The body of the floor tiles of the present invention can be formed from a variety of materials. In one embodiment the body is formed from a polymeric material. Examples of suitable polymeric materials include, without limitation, PVC, EVA, EVP, PP, PE, Acrylics, ABS, and derivatives and combinations thereof. The polymeric floor tiles can also include various fillers, additives, etc., as would occur to one having ordinary skill in the relevant art. The present floor tiles are well suited to be formed using extrusion, protrusion and/or pultrusion technology, such processes being relatively well known in the present field of endeavor. Of course, other manufacturing methods, such as injection molding, can also be utilized to form the floor tiles.

In one aspect of the invention, the upper surface 12, the support members or rails 14, and the interconnecting members 20 can be formed as an integral piece. The floor tiles or planks can be provided in a variety of lengths, and can be cut to specific lengths by the installer when installed (as discussed in more detail below).

Figure 2B:
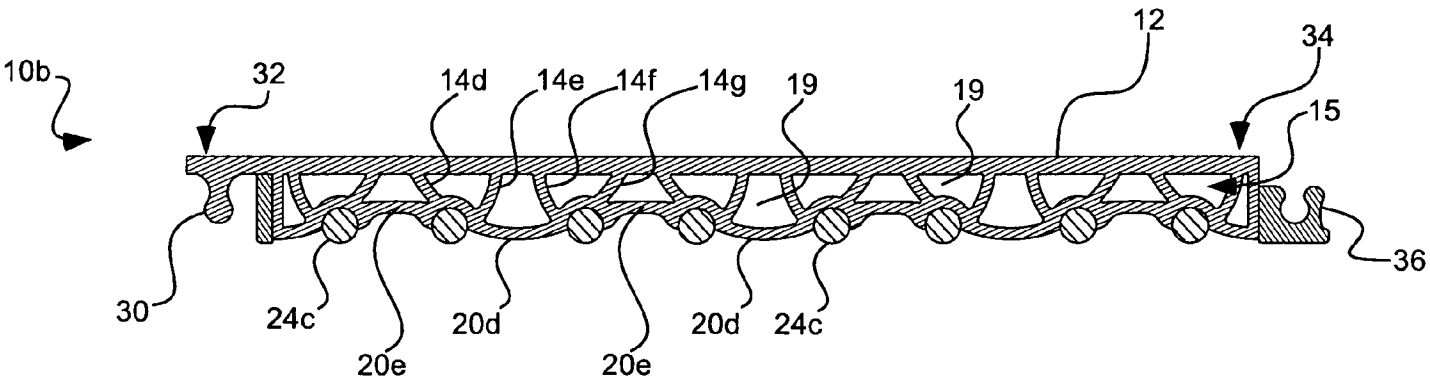
FIG. 2B is an end view of a section of another floor tile in accordance with an aspect of the invention.

FIGS. 2A and 2B illustrate two different embodiments of the floor tile, both shown in cross section. The tile 10 of FIG. 2A includes a series of support members or rails 14, some of which extend from the underside 16 of the upper surface 12 in a substantially vertical orientation (e.g., support members 14*c*). Other support members, for example support members 14*a* and 14*b*, can extend from the underside of the upper surface at an oblique angle to the upper surface. Interconnecting members 20*a* can extend between two or more of the support members in a concave orientation, while interconnecting members 20*c* can extend between two or more of the support members in a convex orientation. Interconnecting members 20*b* can extend in a substantially horizontal orientation between two or more of the support members. The orientation of the support members 14 and the interconnecting members 20 can vary, with various repeating geometric patterns being possible.

As also shown in FIG. 2A, in one aspect of the invention, at least one section of engagement material 24 can be associated with the various components defining the subfloor contact profile. The engagement material can be associated with the various components in a number of manners. For example, it can be carried by the components, coupled to the components, formed integrally with the components, welded to the components, co-extruded with the components, etc. The engagement material can be formed of a material that is relatively more pliable or compliant than the material comprising the floor tile body. In one embodiment of the invention, the components comprising the subfloor contact profile can be formed of the same material as the floor tile body, while the pliable engagement material can be formed of a relatively more pliable material, including, without limitation, elastomeric materials such as rubber, synthetic rubber, neoprene, PVC, etc., as well as derivatives and combinations thereof. The engagement material can provide a relatively high frictional interface between the floor tile and the subfloor over which the floor tiles of the present invention are laid or installed.

In one embodiment of the invention, the engagement material 24 can be applied as relatively long, thin strips at strategic locations along the bottom portions of the tile to provide an interface that is not prone to slippage. In addition, the engagement material can enhance a noise abatement quality of the floor tile: e.g., can aid in reducing or eliminating any sound that might otherwise be generated as the components of the subfloor contact profile contact the subfloor during use. The engagement material can also serve to limit any gouging, abrading or similar disturbance of the subfloor by the flooring tiles. In addition, the engagement material can add to the resiliency of the floor tile by providing additional "cushioning" to the floor tile.

Also, the engagement material can aid in providing a relatively high-friction interface between the bottom of the floor tile and the underlying subfloor. In this manner, the floor tiles are not prone to movement on, about or over the subfloor once installed or placed on the subfloor, even in the case where the subfloor is relatively "slippery." The present tiles can perform this function without requiring or benefiting from the use of adhesives, the use of which can greatly increase the time and expense of installing floor tiles, and can add the risk of exposure to hazardous chemicals.

In one aspect, the engagement material 24 can be varied according to a desired response, stiffness, performance, impact protection, shock-absorption and/or resiliency of the floor tile. For example, where a more rigid response is desired, the engagement material can be selected to be relatively more stiff. When a more forgiving, or higher resiliency floor is desired, a softer, more pliable engagement material can be selected. The engagement material 24 can be applied to the floor tile at the time of manufacture of the floor tile. For example, the engagement material can be applied during a co-extrusion process. Alternately the engagement material can be bonded, welded, snapped, pressed, rolled or otherwise attached or joined to the floor tile after the body of the floor tile has been formed. The engagement material can be provided in a variety of widths and shapes. As shown in FIG. 2A, the connecting member 20*a* can include a strip of engagement material 24*a* that substantially matches the shape of the connecting member 20*a*.

In the floor tile 10*b* of FIG. 2B, the engagement material 24*c* can be formed as a series of elongate, cylindrical or polyhedral pieces that can be received within a plurality of corresponding, recessed structure of the floor tile. This embodiment of the invention also includes a series of support members 14*d*, 14*e*, 14*f* and 14*g* that are arcuate in shape and collectively form a repeating geometric pattern of half-circular groupings. In this embodiment, the interconnecting members 20*d* are also generally arcuate in shape, and interconnect the arcuate support members along the same half-circular path. Interconnecting members 20*e* can be generally horizontal in orientation.

As also illustrated in FIGS. 2A and 2B, in one embodiment of the invention, the floor tiles 10, 10*b* of the present invention can include a protruding connecting member 30 that can be associated with a lateral edge 32 of the floor tiles. A gutter connecting member 36 can similarly be associated with an opposite lateral edge 34 of the floor tile. The protruding connecting member and the gutter connecting member can be operable to provide substantially liquid-tight lateral edge connection of adjacent floor tiles. In use, a protruding connecting member of one tile is engaged within (or "snapped" within) a gutter connecting member of an adjacent tile to form a secure lateral connection between the two tiles. As with the support members 14 and interconnecting members 20, the protruding connecting member and the gutter connecting member can extend along substantially the entire length of the tile.

Referring again to FIG. 2A, in one aspect of the invention, the floor tile 10 can be provided with a dual-stage deflection response in which resistance to a compressive load can increase once a predetermined level of deflection of the components of the floor tile has been reached. In one embodiment, the floor tile can include one or more "hard stop" extensions 17 that serve to limit or stop further deflection of the tiles once the hard stops come into contact with the subfloor (not shown).

It will be appreciated that, as the floor tile 10 is resting upon the subfloor (with no load being carried by the floor tile), the hard stops 17 will not be in contact with the subfloor. As a load is applied to the floor tile, the upper surface of the floor tile will slowly be deflected downward as the interconnecting members 20*a*, 20*c*, etc., flex in response to the load. When the interconnecting members flex to a sufficient degree, the hard stops (or strips of pliable material 24*b* that can be attached to the hard stops) come into contact with the subfloor. As the hard stops will be much more resistant to flexing (due to their relatively rigid geometry in relation to the direction of deflection of the floor tile), the floor tile will effectively stop deflecting at this point and any further loading of the floor tile will result in a very stiff response by the floor tile.

This aspect of the invention can be advantageous in limiting extreme flexure of the components of the floor tile when under extreme loading conditions, to thereby limit failure of the floor tile due to the extreme loading condition.

As also illustrated in FIGS. 2A and 2B, in one aspect of the invention at least some of the plurality of rails 14*a*, 14*b*, 14*d*, 14*e*, etc., or at least some of the interconnecting members 20*a*, 20*b*, 20*c*, 20*d*, etc., can define alternating concave and convex features. For example, in the embodiment illustrated in FIG. 2A, interconnecting member 20*a* is formed in a concave configuration while interconnecting member 20*c* is formed in a convex configuration (relative to the subfloor on which the floor tile will be installed). Similarly, in the embodiment illustrated in FIG. 2B, interconnecting member 20*d* is concave while interconnecting member 20*e* is at least partially convex.

This feature of the invention has been found to advantageously aid in reducing any "cupping" or "bridging" of the floor tiles after manufacture of the floor tiles. As used herein, the terms cupping and bridging refer to flaws in floor tiles that cause floor tiles to not lie completely flat on a subfloor over which the floor tiles are installed (when not subjected to loading). For example, some floor tiles, when experiencing a zero load state, tend to lift off the subfloor at the corners (an example of "cupping") or tend to lift off the subfloor at the center of the tile (an example of bridging). It is believed that this condition is due, at least in part, to residual stresses formed in components of the tile during cooling of the tile material after manufacturing. As a great many conventional floor tiles include repeating patterns of similarly shaped, if not identical, components, the residual stresses in the component are additive, resulting in sometimes significant bridging or cupping of the tile.

By forming alternating convex and concave sections in the present tiles, the resulting tile is much less susceptible to bridging or cupping, and lies relatively completely flat upon the subfloor over which the present tiles are installed or laid.

Figure 3A:
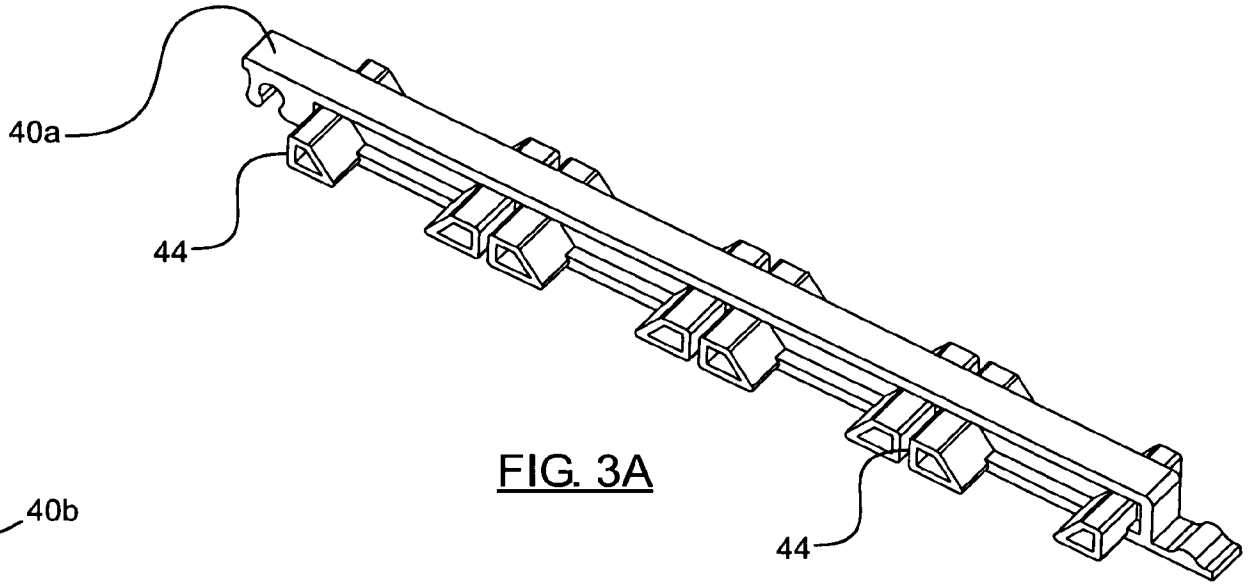
FIG. 3A is a perspective view of a mating connector in accordance with an embodiment of the invention.
Figure 3B:
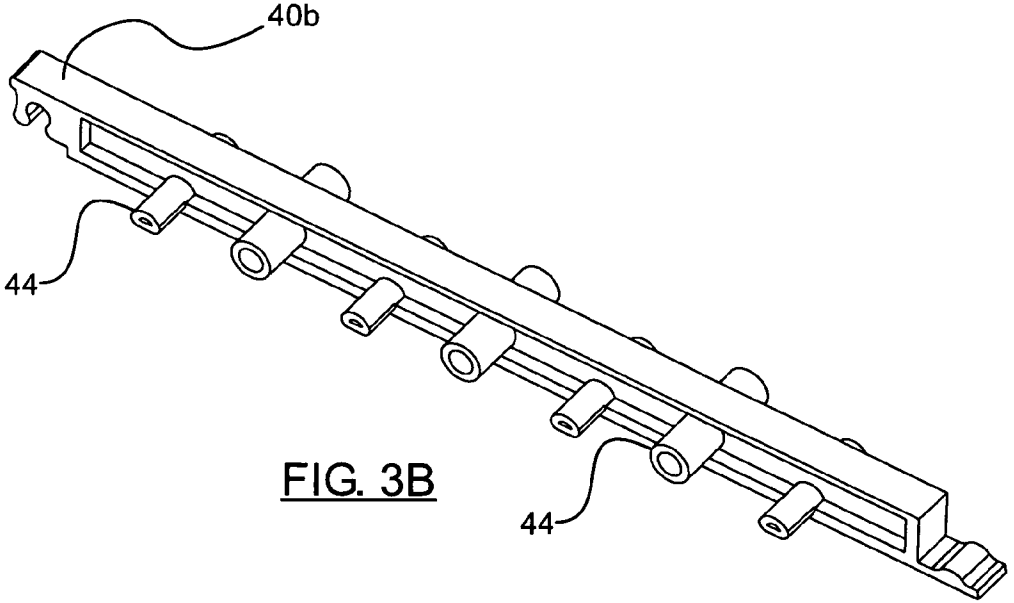
FIG. 3B is a perspective view of a mating connector in accordance with another embodiment of the invention.

FIGS. 3A and 3B illustrate a further feature of the present invention, end mating connectors 40*a* and 40*b*. The mating connectors generally include projections 44 shaped to correspond to the openings 19 (FIGS. 2A and 2B) formed in the tiles. The mating connectors can be sized and shaped to be received within end portions of the floor tile (within the openings) and can be operable to provide substantially liquid-tight end edge connection of adjacent floor tiles.

Figure 4:
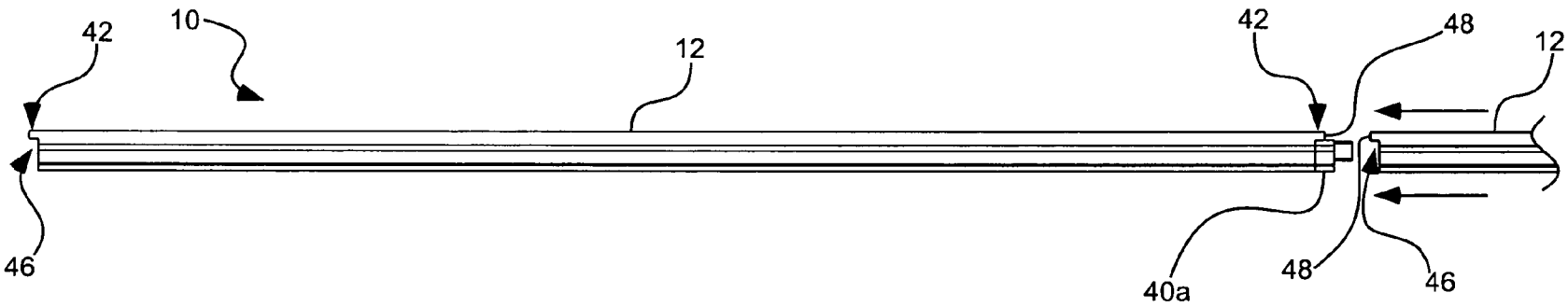
FIG. 4 is a lateral edge view of a floor tile being mated along an end edge with another floor tile in accordance with an aspect of the invention.

As shown in FIG. 4, the mating connectors allow end edges 42 of floor tiles 10 to be connected to one another in a secure manner. During installation of the tiles (or during manufacture of the tiles) an undercut 46 can be made in the end edges of the tiles and, when it is desired to connect to tiles at the end edges, a mating connector 40*a* or 40*b* can be inserted within the end of the tiles and pressed between two tiles beneath the undercut. When the two tiles are pressed together, overhang portions 48 formed during undercutting of the tile end edges can be mated together over the mating connector to form a substantially liquid-tight seal between the end edges of the tiles.

During a typical installation process (not shown in the figures), an installer can place or lie a first tile in position on a subfloor. A second, adjacent tile can be disposed near a lateral edge of the tile, and a protruding connecting member of one tile can be inserted within a gutter connecting member of an adjacent tile to laterally connect the tiles one to another. If a length of the tile need be adjusted, a simple saw or router cut can be used by the installer to size the length of the tile. A mating connector (40*a* or 40*b*) can be inserted between end edges of two lengthwise adjacent tiles, and the two tiles can be pressed together to form an end joint.

This process can be continued until enough modular floor tiles have been assembled to form a substantially continuous sheet that covers the desired area. As the floor tiles are formed from a polymer, installers can easily cut tile lengths or widths to size, as necessary, without requiring a great deal of specialized tooling.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

We claim:

1. A resilient floor tile for use in a flooring system, comprising:

an upper surface; and a support lattice operable to resiliently support the upper surface, the support lattice including:

a plurality of support members extending downwardly from an underside of the upper surface and terminating in lower sections; and a plurality of interconnecting members laterally interconnecting the lower sections of at least two support members and collectively defining a subfloor contact profile, wherein at least two of the interconnecting members define alternating arcuate concave and convex support members.

2. The floor tile of claim 1, wherein the upper surface comprises a substantially continuous plane.

3. The floor tile of claim 1, wherein the upper surface, the support members and the interconnecting members are formed as an integral piece.

4. The floor tile of claim 1, wherein the support members and the interconnecting members extend longitudinally substantially along an entire length of the underside of the upper surface of the floor tile.

5. The floor tile of claim 1, further comprising at least one section of engagement material carried by the subfloor contact profile, the engagement material being formed of a material relatively more pliable than the subfloor contact profile.

6. The floor tile of claim 1, further comprising:

a protruding connecting member associated with a lateral edge of the floor tile; and a gutter connecting member associated with an opposite lateral edge of the floor tile;

the protruding connecting member and the gutter connecting member being operable to provide substantially liquid-tight lateral edge connection of adjacent floor tiles.

7. The floor tile of claim 6, further comprising at least one separable mating connector sized and shaped to be received within end edge portions of the floor tile, the mating connector being operable to provide substantially liquid-tight end edge connection between adjacent floor tiles.

8. A resilient floor tile for use in a flooring system, comprising:

an upper surface;

a support lattice configured to resiliently support the upper surface, the support lattice including:

a plurality of rails extending longitudinally and downwardly from an underside of the upper surface and terminating in lower sections;

a plurality of interconnecting members laterally interconnecting the lower sections of at least two rails to collectively define a subfloor contact profile wherein at least two of the interconnecting members define alternating arcuate concave and convex support members; and at least one section of engagement material carried by a lowermost section of the plurality of interconnecting members, the engagement material being formed of a material relatively more pliable than the subfloor contact profile.

9. The floor tile of claim 8, wherein the upper surface comprises a substantially continuous plane.

10. The floor tile of claim 8, further comprising a plurality of deformable elongate openings defined by the underside of the upper surface, the rails and the interconnecting members, and wherein the elongate openings allow the rails and interconnecting members to flex in response to a load applied to the upper surface.

11. The floor tile of claim 10, further comprising at least one separable mating connector sized and shaped to be received within the elongate openings accessible from the end edges of the floor tile, the separable mating connector being operable to provide substantially liquid-tight end edge connection of adjacent floor tiles.

12. The floor tile of claim 8, wherein the upper surface, the plurality of rails and the interconnecting members are formed as an integral piece.

13. The floor tile of claim 8, wherein the rails and the interconnecting members extend longitudinally substantially along an entire length of the underside of the upper surface of the floor tile.

14. The floor tile of claim 8, wherein at least some of the rails include an arcuate shape.

15. The floor tile of claim 8, wherein at least some of the plurality of rails extend from the underside of the upper surface at an oblique angle to the upper surface.

16. The floor tile of claim 8, further comprising:

a protruding connecting member associated with a lateral edge of the floor tile; and a gutter connecting member associated with an opposing lateral edge of the floor tile;

the protruding connecting member and the gutter connecting member being operable to provide substantially liquid-tight lateral edge connection of adjacent floor tiles.

17. A resilient floor tile for use in a flooring system, comprising:

an upper surface; and a support lattice resiliently supporting the upper surface, the support lattice including:

a plurality of rails extending longitudinally along an underside of the upper surface and defining a plurality of open spaces therebetween, the plurality of rails extending downwardly from the underside of the upper surface and terminating in lower sections; and a plurality of interconnecting members laterally interconnecting the lower sections of two or more of the rails and at least partially enclosing the open spaces defined therebetween to form a plurality of elongate openings having a deformable quadrilateral geometry, and to collectively define a subfloor contact profile, wherein the elongate deformable openings allow at least some of the plurality of rails and interconnecting members to flex in response to a load applied to the upper surface;

wherein at least two of the interconnecting members define alternating arcuate concave and convex support members.

18. The floor tile of claim 17, wherein the deformable quadrilateral geometry further comprises at least two angled rails disposed between two vertical rails, wherein the angled rails extend downwardly from the underside of the upper surface at an oblique angle greater than or about 30 degrees from perpendicular to the underside of the upper surface.

19. The floor tile of claim 17, wherein the upper surface, the plurality of rails and the interconnecting members are formed as an integral piece.

20. The floor tile of claim 17, wherein the rails and the interconnecting members extend longitudinally substantially along an entire length of the underside of the upper surface of the floor tile.

21. The floor tile of claim 17, further comprising at least one section of engagement material carried by the subfloor contact profile, the engagement material being formed of a material relatively more pliable than the subfloor contact profile.

22. The floor tile of claim 17, further comprising:

a protruding connecting member associated with a lateral edge of the floor tile; and a gutter connecting member associated with an opposing lateral edge of the floor tile;

the protruding connecting member and the gutter connecting member being operable to provide substantially liquid-tight lateral edge connection of adjacent floor tiles.

23. The floor tile of claim 22, further comprising at least one mating connector sized and shaped to be received within end portions of the floor tile, the mating connector being operable to provide substantially liquid-tight end edge connection of adjacent floor tiles.

24. The floor tile of claim 17, wherein at least some of the plurality of rails extend from the underside of the upper surface at an oblique angle to the upper surface.

25. The floor tile of claim 17, wherein at least some of the alternating arcuate concave and convex support members are positioned relative to a tile support surface.

26. The floor tile of claim 17, wherein the plurality of rails includes at least one at least partially concave rail and at least one at least partially convex rail.

* * * * *